US007857104B2

(12) United States Patent
Kocher

(10) Patent No.: US 7,857,104 B2
(45) **Date of Patent: *Dec. 28, 2010**

(54) METHOD OF PREVENTING COLLISION OF TWO ELEVATOR CARS

(75) Inventor: Hans Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 438 days.

This patent is subject to a terminal disclaimer.

(21) Appl. No.: 11/962,630

(22) Filed: Dec. 21, 2007

(65) Prior Publication Data

US 2008/0236954 A1 Oct. 2, 2008

(30) Foreign Application Priority Data

Dec. 21, 2006 (EP) ..... 06126796

(51) Int. Cl.
*B66B 9/00* (2006.01)

(52) U.S. Cl. ..... 187/249; 187/391

(58) Field of Classification Search ..... 187/247, 187/249, 380–388, 391–393
See application file for complete search history.

(56) References Cited

U.S. PATENT DOCUMENTS

| | | | | |
|---|---|---|---|---|
| 1,911,834 A | | 5/1933 | Lindquist | |
| 5,663,538 A | * | 9/1997 | Sakita | 187/382 |
| 5,877,462 A | * | 3/1999 | Chenais | 187/249 |
| 7,353,912 B2 | * | 4/2008 | Reuter et al. | 187/249 |
| 7,448,471 B2 | * | 11/2008 | Nuebling | 187/286 |
| 2008/0053757 A1 | * | 3/2008 | Kostka | 187/394 |
| 2008/0067014 A1 | * | 3/2008 | Kocher et al. | 187/393 |
| 2010/0206668 A1 | * | 8/2010 | John et al. | 187/247 |

FOREIGN PATENT DOCUMENTS

| | | |
|---|---|---|
| EP | 1 329 412 A1 | 7/2003 |
| EP | 1 700 809 A | 9/2006 |
| EP | 06 12 0359 | 9/2006 |
| WO | WO 2004/043842 A | 5/2004 |

* cited by examiner

*Primary Examiner*—Jonathan Salata
(74) *Attorney, Agent, or Firm*—Fraser Clemens Martin & Miller LLC; William J. Clemens

(57) ABSTRACT

A method of preventing a collision of two elevator cars of an elevator installation, which cars move substantially independently of one another in a common shaft, and an elevator installation includes a collision protection system that produces a retardation of each moved elevator car by a stopping brake as soon as the effective distance between the elevator cars falls below a critical minimum distance. After retardation of the cars by the stopping brakes, an emergency stop system comes into function. A control system of this emergency stop system ascertains the instantaneous movement state of the elevator cars. With the help of the car brakes, which are associated with the elevator cars, an additional retardation of each moved elevator car is triggered when the movement state thereof fulfils definable emergency stop criteria.

11 Claims, 4 Drawing Sheets

METHOD OF PREVENTING COLLISION OF TWO ELEVATOR CARS

FIELD OF THE INVENTION

The invention relates to a method of preventing collision of two elevator cars, which are movable in the same elevator shaft of an elevator installation.

BACKGROUND OF THE INVENTION

Elevator installations with several elevator cars in the same shaft, which are also termed multi-mobile elevator installations, usually have a respective driving and braking system per elevator car. Moreover, such elevator installations are equipped with a collision protection system by which collisions of the elevator cars are to be avoided.

Apart from conventional electronically controlled collision protection systems an elevator installation with a collision protection system with electromechanical switching mechanisms able to be mechanically triggered has been described by European Patent Application EP 06 120 359. The disclosure of this European Patent Application is regarded as an integral part of the present application. The mentioned collision protection system is simple in construction and reliable in its operation. However, it is disadvantageous that its triggering takes place merely when a critical minimum distance between two approaching elevator cars is fallen below without further braking criteria such as, for example, the relative speed between the elevator cars or the instantaneous effective distance, in each instance after triggering of the stopping brake, being taken into consideration. Particularly in the case of high car speeds and emergency situations it cannot be guaranteed with ultimate certainty that a further elevator car disposed above or below still stops at the right time to avoid a collision.

SUMMARY OF THE INVENTION

An object of the present invention is to propose a method in order to trigger, in the case of a multi-mobile elevator installation, an additional braking when the distance between the elevator cars further reduces, notwithstanding triggering of stopping brakes by means of a collision protection system, so that an immediate emergency stop is required, and to create a multi-mobile elevator installation operable according to this method.

The emergency stop system shall in this connection be conceived as far as possible so that it does not oblige any enlargement of the shaft cross-section.

The new elevator installation comprises at least one upper elevator car and at least one lower elevator car. The two elevator cars can move vertically upwardly and downwardly, substantially independently of one another, in a common elevator shaft of the elevator installation.

The upper elevator car has a first driving and braking system comprising a first stopping brake (preferably a motor brake). The lower car has a second driving and braking system which includes a second stopping brake (preferably a motor brake). According to the present invention the first elevator car is additionally equipped with a first car (emergency) brake and the second elevator car with a second car (emergency) brake, the function of which is explained in more detail further below.

Moreover, the elevator installation has a collision protection system in order to avoid collisions between the elevator cars. The collision protection system preferably comprises a first electromechanical switching mechanism at the upper elevator car and a second electromechanical switching mechanism at the lower elevator car, by which retardation of the upper elevator car by the first stopping brake and/or retardation of the lower elevator car by the second stopping brake can be triggered. However, the elevator cars and the collision protection system can, in particular, be constructed—but do not necessarily have to be constructed—in accordance with EP-06120359.

According to the present invention an emergency stop system is in addition provided. The emergency stop system is so designed that after triggering of the retardation or braking by the stopping brakes it continuously or repeatedly ascertains the instantaneous movement state of the two elevator cars and triggers an additional braking of one or both moved elevator cars by means of an associated car brake if this, with consideration of the movement state of the elevator cars on the one hand and with consideration of ascertainable braking criteria on the other hand, is necessary.

The movement state of the elevator cars is inter alia and substantially a function of their relative speed.

Braking criteria can in principle be ascertained in advance, but advantageously the instantaneous movement state of the elevator cars is included.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner In respect of the methods disclosed, the steps presented are exemplary in nature, and thus, the order of the steps is not necessary or critical.

Figure 1:
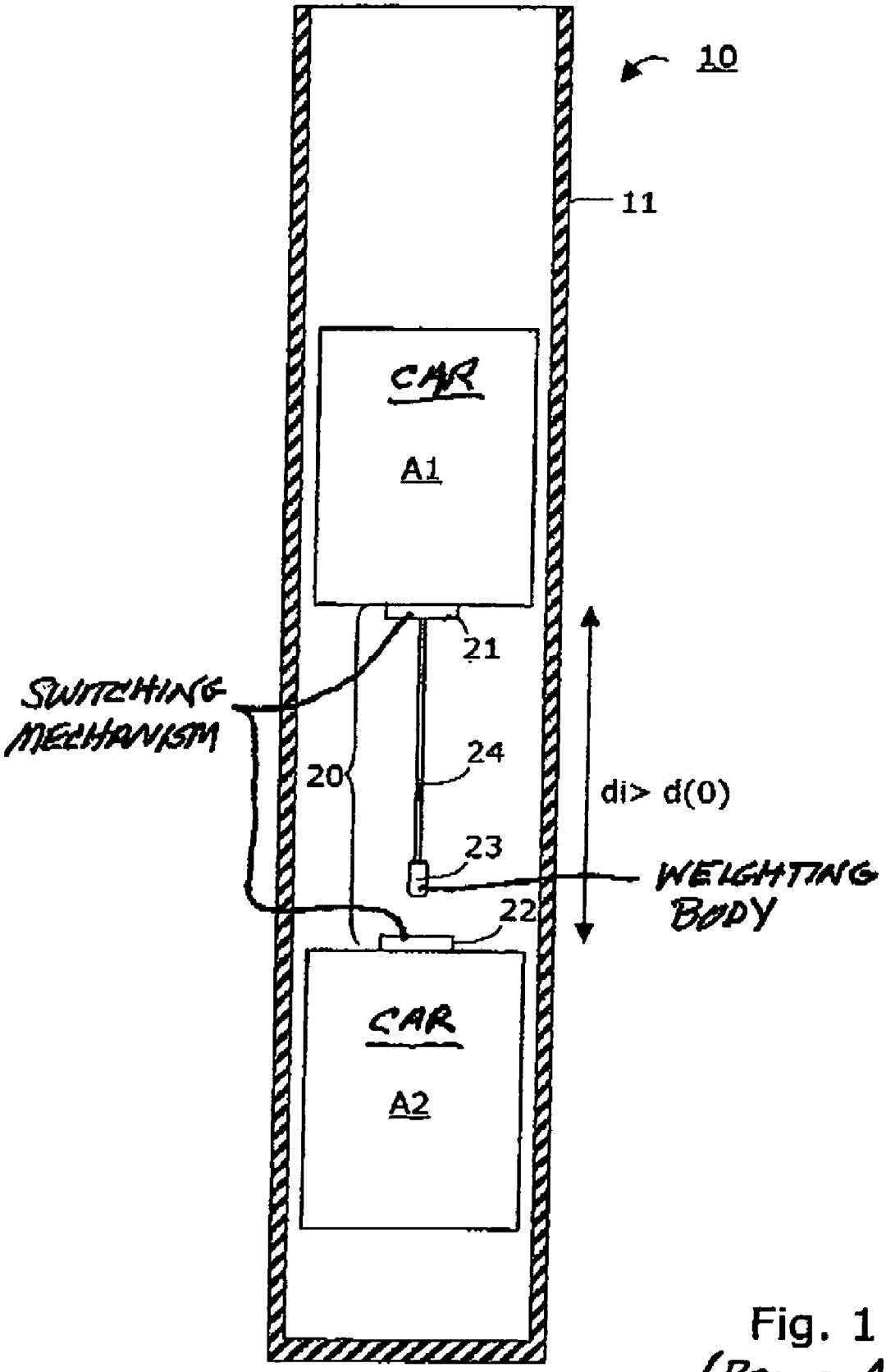
Fig. 1 (PRIOR ART)
FIG. 1 is schematic side elevation view of a multi-mobile elevator installation according to the state of the art.

FIG. 1 shows a simple elevator installation 10. Such elevator installations are, as mentioned further above, known under the designation multi-mobile elevator installations. The elevator installation 10 has an elevator shaft 11 in which an upper elevator car Al and a lower elevator car A2 can move vertically. As long as a critical minimum distance "d(0)" between the two elevator cars A1, A2 is maintained, i.e. during normal operation where the instantaneous spacing "di" is greater than the critical minimum distance "d(0)", the elevator cars A1, A2 can move independently of one another in the elevator shaft 11. The elevator installation 10 has a driving and braking unit, wherein preferably each of the elevator cars A1, A2 has an individual driving and braking system.

The elevator installation 10 additionally has a collision protection system 20. The collision protection system 20 comprises a first electromechanical switching mechanism 21 which is arranged in a lower region of the upper elevator car A1 and a second electromechanical switching mechanism 22 which is arranged in an upper region of the lower elevator car A2. The two switching mechanisms 21, 22 are mounted in vertical alignment one above the other, The collision protection system 20 of the elevator installation 10 preferably comprises, for each elevator car A1, A2, an individual safety circuit in which several safety elements such as, for example, safety contacts and safety switches, are arranged in series. The corresponding elevator car A1 or A2 can be moved only if its safety circuit and thus all safety contacts integrated therein are closed. The safety circuit is connected with the driving and braking unit of the elevator installation 10 or the driving and braking systems of the elevator cars A1, A2 in order to interrupt travel operation of the corresponding elevator car A1 and/or A2 if the safety circuit is opened by actuation of the corresponding electromechanical switching mechanism 21 and/or 22.

The first switching mechanism 21 comprises a weighting body 23 with a weight G suspended at an elongate flexible support element 24, which in turn is fastened at the lower region of the upper elevator car A1. The entire vertical dimension of the support element 24 and the weighting body 23 substantially corresponds with the critical distance "d(0)" to be maintained between the elevator cars A1, A2.

The second switching mechanism 22 comprises a mechanical sensor in the form of a lever 28 (see FIG. 2), which acts on a contact switch 34.

In the normal case, i.e. when the spacing "di" between the elevator cars A1 and A2 is greater than the critical distance "d(0)", the weighting body 23 hangs freely at the support element 24, which is disposed under tensile stress and kept stretched by the weight G of the waiting body 23.

If the elevator cars A1, A2 approach to such an extent that the instantaneous space "di" thereof falls below the critical distance "d0" then the weighting body 23 impinges on the lever 28 of the second electromechanical switching mechanism 22. The tensile force exerted by the weighting body 23 on the support element 24 thereby reduces and thus substantially the tensile stress in the support element 24.

Due to the considerable reduction in the tensile stress in the support element 24 the safety circuit of the first driving and braking unit of the upper elevator car A1 is opened. Retardation of the upper elevator car A1 by means of the first stopping brake (for example, designed as a motor brake) is thereby triggered. Through the impinging of the waiting body 23 on the lever 28 the safety circuit of the second driving and braking unit of the lower elevator car A2 is opened at virtually the same time. Retardation of the lower elevator car A2 by means of the second stopping brake (for example, designed as a motor brake) is thereby triggered.

However, the emergency stop system according to the present invention can also be used in elevator installations 10 of which the collision protection system is of different design or of which the stopping brakes can be triggered in a different manner and/or which are equipped with a safety bus system instead of the mentioned safety circuits.

According to the present invention the elevator installation 10 has, in addition to the collision protection system 20, the emergency stop system by which after retardation of one or both elevator cars A1, A2 by one or both stopping brakes an additional retardation of the moved elevator cars A1 and/or A2 can be achieved. Triggering of this additional retardation takes place with consideration of the instantaneous movement state of the elevator cars A1, A2 and on the basis of emergency stop criteria.

The emergency stop system of the present invention can comprise constructional elements of the collision protection system 20 and additional constructional elements, i.e. the emergency stop system in this case is at least partly integrated in the collision protection system 20.

Figure 2:
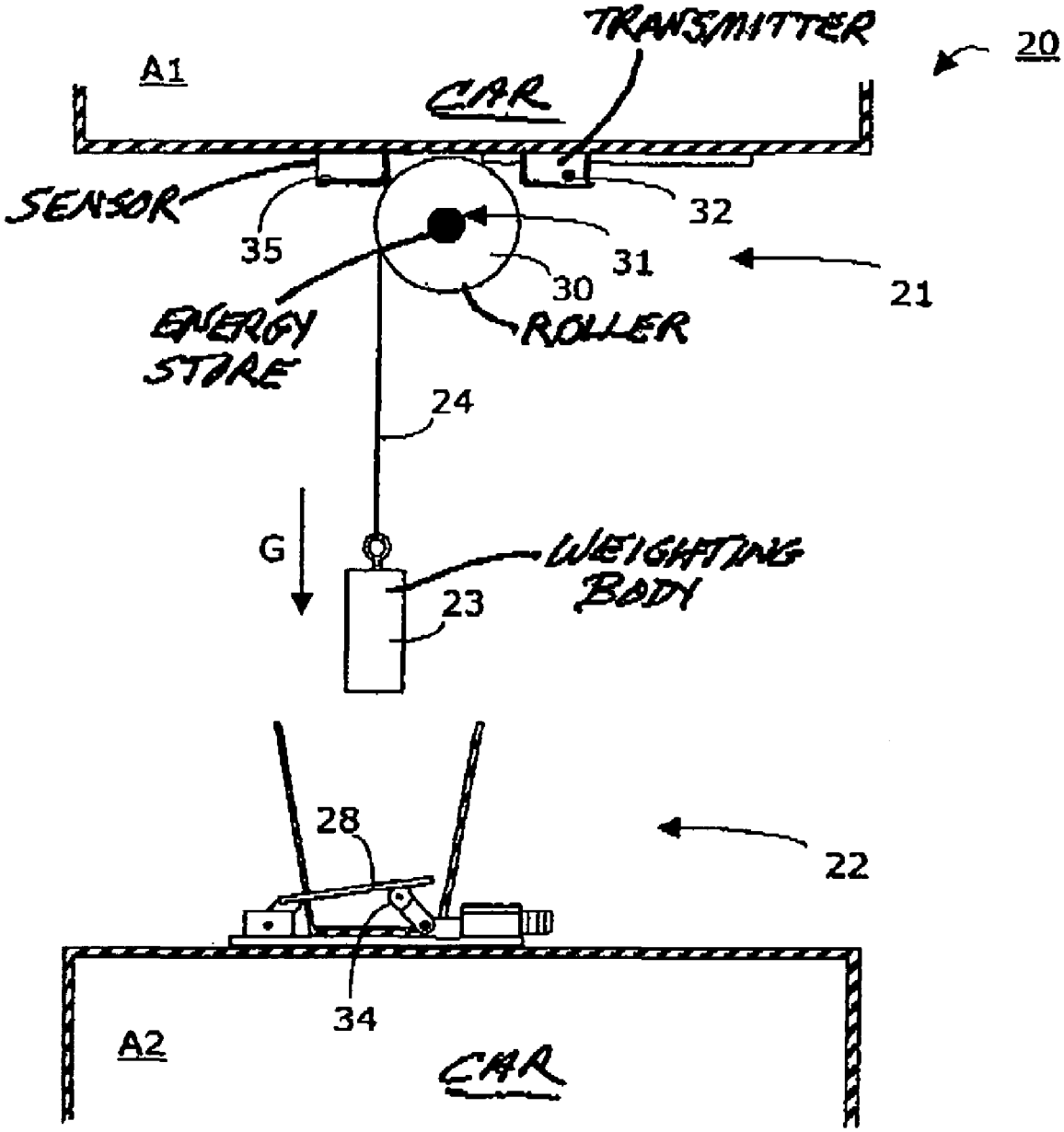
FIG. 2 is an enlarged schematic view of a collision protection system and an emergency stop system at the multi-mobile elevator installation of FIG. 1 according to the present invention.
Figure 4:
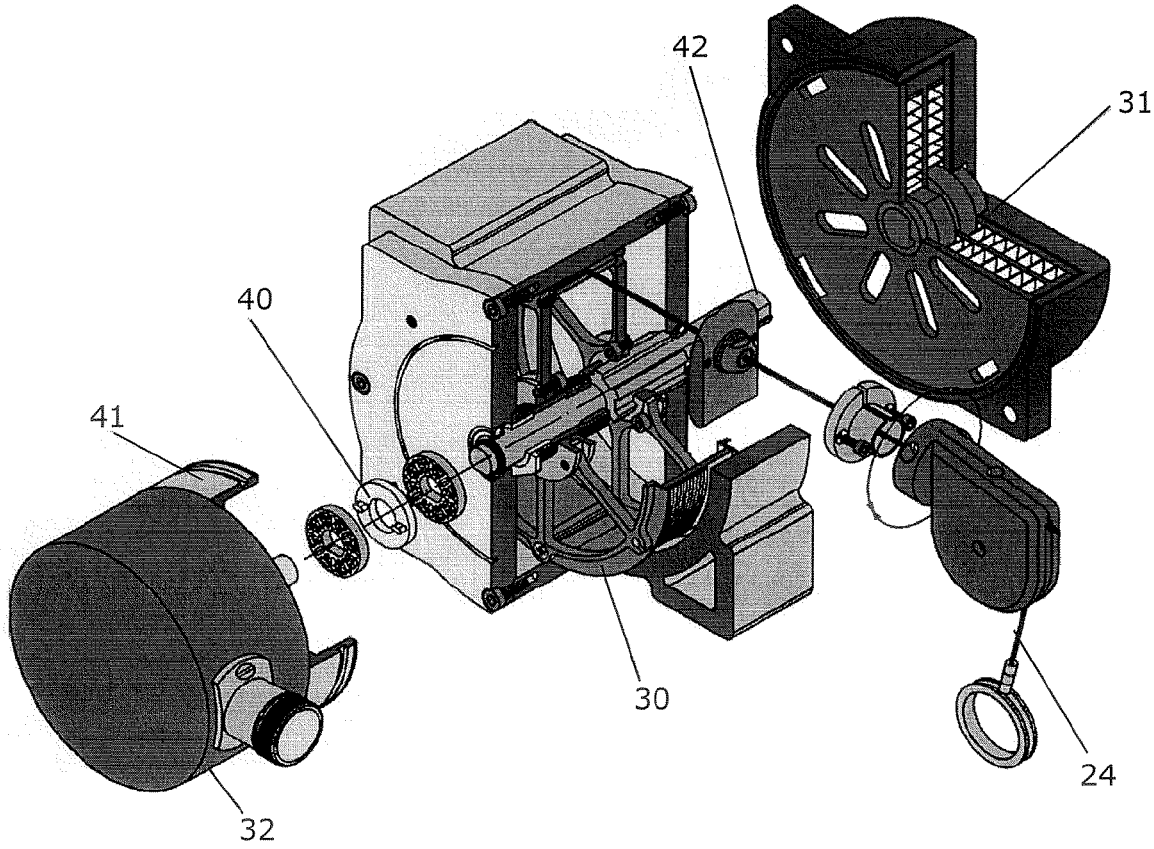
FIG. 4 is an exploded perspective view of the upper switching mechanism shown in FIG. 2.

In the case of a collision protection system of an elevator installation 10 according to the present invention and in accordance with FIG. 2 it is provided that the flexible support element 24 is not fastened directly or fixedly at the lower region of the upper elevator car A1 or at a lever disposed there, but is mounted at a roller 30. The roller 30 is in turn rotatably fastened at the lower region of the upper elevator car A1. This fastening is not shown in FIG. 2. The roller 30 has an internal energy store 31 (or an attached energy store 31, as shown in FIG. 4), preferably in the form of a spiral spring, which exerts a force having a tendency to so rotate the roller 30 (in the illustrated example this rotation would act in a clockwise sense) that the flexible support element 20 is wound up on the roller 30. In the normal case, i.e. when the instantaneous spacing "di" between the elevator cars A1 and A2 is greater than the critical distance "d0", the roller 30 is blocked against rotation and, in particular, by the tension force which the flexible support element 24 loaded by the weight G of the weighting body 23 exerts. This means that the roller 30 cannot, due to this blocking, be brought by means of its internal energy store 31 into rotation. As soon as a retardation of the elevator cars A1, A2 has been initiated by the stopping brakes because the instantaneous distance "di" between the elevator cars A1 and A2 falls below the critical distance "d0", the emergency stop system or its control system is activated. In the present case this takes place by impinging of the weighting body 23 on a sensor (for example the lever 28 in conjunction with a switch 34) of the switching mechanism 22 of the lower elevator car A2. After impinging of the weighting body 23 the tension force in the flexible support 24, by which the roller 30 was blocked, diminishes. The roller 30 is now freed and rotates under the winding-up torque delivered by its internal force store 31 so that the flexible support element 24 is wound up on the roller 30. The release of the roller 30 takes place virtually simultaneously with the actuation of the electromechanical switching mechanisms 22 and the retardation of the elevator cars A1, A2 by the stopping brakes thereof.

The roller 30 rotates after release thereof and in that case that part of the flexible element 24 substantially corresponding with the difference between the critical distance "d0" and the instantaneous spacing "di" of the elevator cars A1, A2 is wound up. In this connection, however, the weighting body 23 does not have to be drawn upwardly. The winding-up torque exerted by the internal energy store 21 on the roller 30 thus has to exert on the flexible support element 24 a winding force which is less than the weight "G(23)" of the weighting body 23, but greater than the weight "G(24)" of the flexible support element 24, wherein the frictional forces also have to be taken into consideration.

The rotation of the roller 30 allows detection of the instantaneous movement state of the elevator cars A1, A2 proceeding from the instantaneous angular speed "ωI" and the instantaneous distance "di" between the elevator cars A1 and A2. As soon as the roller 30 rotates, its angular speed "ωI", which is a function of time, is detected by an incremental transmitter 32. The instantaneous relative speed "vi(rel)" of the elevator cars A1, A2 can then be ascertained from this angular speed "ωI". The instantaneous distance "di" between the elevator cars A1, A2 can then be similarly ascertained, either by means of a travel measuring sensor 35 or in computerized manner with utilization of the instantaneous angular speed "ωI" of the roller 30. Subsequently, it is clarified with consideration of the thus-ascertained movement state and the emergency stop criteria whether an additional retardation of one or both elevator cars A1, A2 is to be triggered by the car brakes thereof.

How this can be realized is explained by way of example in the following. The following symbols are used:

d0 critical distance (maximum detection distance)

di instantaneous distance of the elevator cars A1, A2

ωi instantaneous angular speed of the roller 30 vi(rel) instantaneous relative speed of the elevator cars A1, A2 vi instantaneous speed of one of the elevator cars vi(A1) instantaneous speed of the upper elevator car A1 vi(A2) instantaneous speed of the lower elevator car A2 a(min) minimum attainable retardation in an emergency stop $s_{stop}$(min)I minimum stopping distance if only one elevator car A1 or A2 is in motion (i.e. if vi(rel)=vi actual)

$s_{stop}$(min)II minimum stopping distance if both elevator cars A1 and A2 are in motion (i.e. if (v(rel)/2)=vi actual)

In addition, the following assumptions or rules apply:

If in the context of the present description both elevator cars A1 and A2 are moving, then they approach at the same speeds vi(A1)=vi(A2), wherein vi(A1) and vi(A2) are absolute values.

If a contact switch 34 of the safety circuit of the lower elevator car A2 is open and/or the instantaneous distance "di" between the elevator cars A1 and A2 is less than the critical distance "d0", then a retardation of each moved elevator car A1, A2 takes place through retardation by means of the stopping brakes thereof.

Emergency stop criteria—An emergency stop or a braking by one or both car brakes is triggered, additionally to braking by the stopping brakes, if one of the following two emergency stop criteria is fulfilled:

Emergency stop criterion A: If an elevator car A1 or A2 is moving and the instantaneous distance "di" between the cars A1 and A2 is less than or equal to the corresponding minimum stopping distance $s_{stop}$(min)I then braking is triggered by the car brake of the moving elevator car A1 or A2.

Emergency-stop criterion B: If both elevator cars are moving and the instantaneous distance "di" between the elevator cars A1 and A2 is less than or equal to the corresponding minimum stopping distance $s_{stop}$(min)II then retardation is triggered by car brakes of both elevator cars A1 and A2.

For ascertaining the movement state and comparison with the emergency stop criteria, the following are detected or calculated:

By measurement: Is one car not in motion?

Is contact 34 of the safety circuit of the lower elevator car A2 open?

Through calculations: vi(A1)=vi(A2)=vi=0.5 vi(rel)

Figure 3:
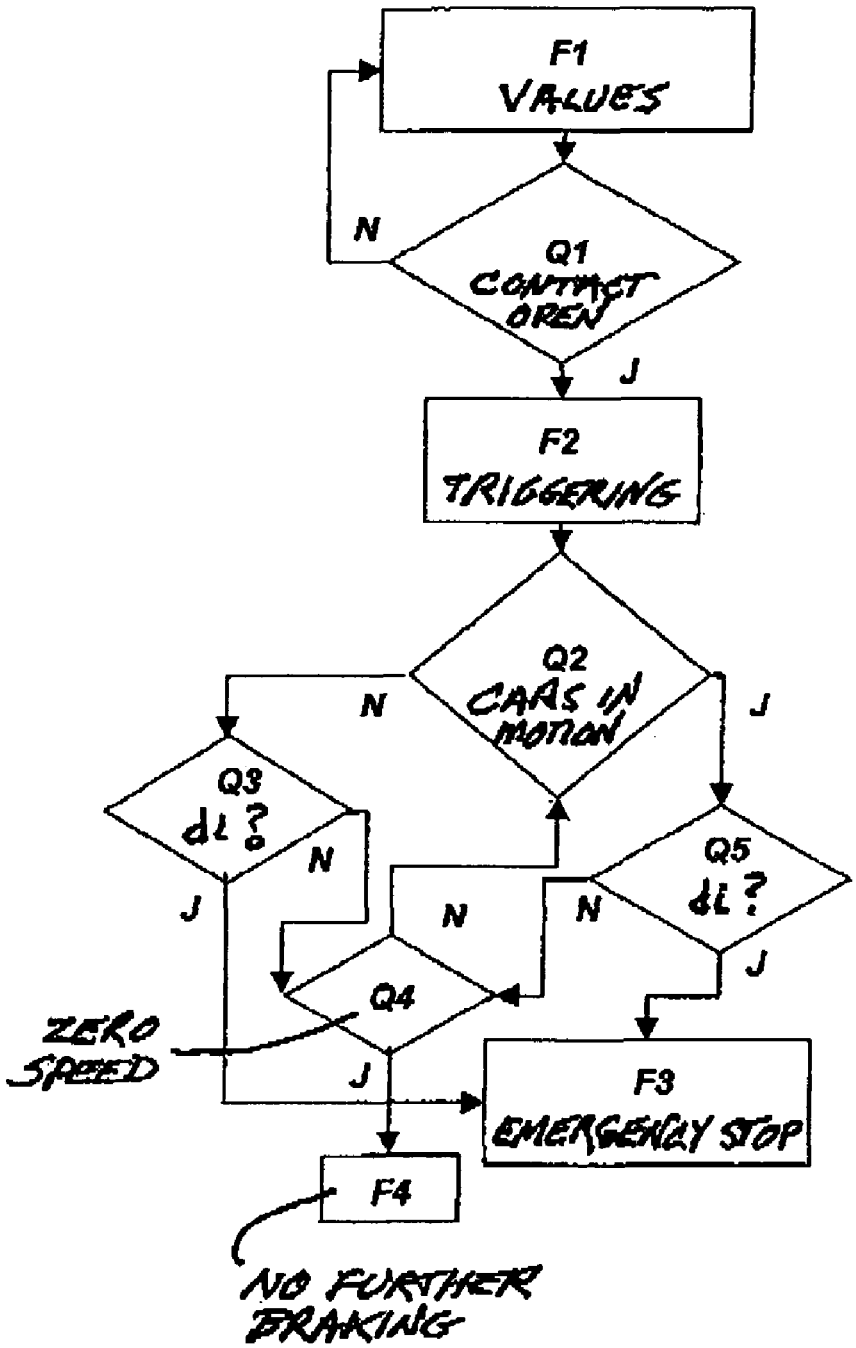
FIG. 3 is a flow diagram of the method according to the present invention.

$s_{stop}(\min)I=(vi(rel))^2/(2*a(\min))$ $s_{stop}(\min)II=(0.5\ vi(rel))^2/(2*a(\min))$ FIG. 3 shows a flow diagram by which the sequence of the entire braking process is explained by way of example with use not only of the stopping brakes, but also of the car brakes.

Box F1 shows measured or available values, namely vi(rel); di; vi(1); vi(2); setting of the contact 34; A1

After these values are available, question Q1 takes place.

It is ascertained by question Q1 whether the contact 34 may be open and/or di<d0.

If question Q1 is answered by no N, then obviously no braking, neither by the stopping brakes nor by the car brakes, is required.

If question Q1 is answered by yes J, then according to box F2 triggering of the stopping brakes takes place, i.e. the emergency stop system is not caused to trigger an additional braking by the car brakes.

Then it is ascertained by question Q2 whether both elevator cars are in motion.

If question Q2 is answered by no N, thus only one of the elevator cars is in motion, then question Q3 is set.

By question Q3 it is ascertained whether "di" may be equal to or even smaller than $s_{stop}$(min)I.

If question Q3 is answered by yes J, thus the minimum stopping distance for this case is reached or exceeded, then according to box F3 an additional retardation by the corresponding car brake takes place for an emergency stop.

If question Q3 is answered by no N, then a further question Q4 takes place.

It is clarified by question Q4 whether the relative speed of the elevator cars may be zero.

If question Q4 is answered by yes J, then this can only mean that now both cars are no longer in motion, because according to box F2 the stopping brakes are triggered and according to answer no N to question Q2 only one elevator car A1 or A2 is in motion. According to box F4 no further braking by use of car brakes is then required, since obviously the braking action of the stopping brake has sufficed.

If question Q4 is answered by no N, then question Q2 is posed again.

If question Q2 is answered by yes J, thus both elevator cars A1 and A2 are in motion, then subsequently question Q5 is posed.

It is clarified by question Q5 whether "di" is the same as or even smaller than $s_{stop}$(min)II.

If question Q5 is answered by no N, then question Q4 is posed for further clarification, i.e. it is clarified by question Q4 whether the relative speed vi(rel) of the elevator cars A1, A2 may be zero. If this is the case, then according to box F4 no additional braking by car brakes is necessary.

If, thereagainst, question Q5 is answered by yes J, then according to box F3 an additional braking by the car brakes for an emergency stop takes place.

If more than two elevator cars move in the same elevator shaft 11, then an appropriate emergency stop system can also be fitted between these elevator cars.

A currently particularly preferred embodiment of a significant part of the emergency stop system 21 is shown in FIG. 4. The roller 30 on which the support means 24 is wound up when it is not loaded by the weighting force of the weighting body 23 suspended thereat can be seen. Seated on the same shaft 42 as the roller 30 is a spring drive 31 which is here also termed an energy store. An incremental transmitter 32 is attached by way of a coupling 40. A connection takes place by way of an adapter 41.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of preventing collision of two elevator cars, which cars move substantially independently of one another in a common shaft, of an elevator installation, wherein a collision protection system triggers a retardation of each moved elevator car by a stopping brake when an effective distance between the elevator cars falls below a critical minimum distance, comprising the steps of:

after triggering of the stopping brake activating an emergency stop system that upon activation ascertains, by a control system, instantaneous movement states of the elevator cars; and the emergency stop system triggers, by the car brakes associated with the elevator cars, an additional retardation of one or both of the elevator cars when a movement state thereof fulfils definable emergency stop criteria.

2. The method according to claim 1 wherein the emergency stop criteria are ascertained with consideration of the instantaneous movement states of the elevator cars.

3. The method according to claim 1 wherein the control system fo ascertaining the instantaneous movement states of the elevator cars repeatedly detects the instantaneous relative speed of the elevator cars, with consideration of the instantaneous relative speed ascertains an instantaneous effective distance between the elevator cars, ascertains as an emergency stop criteria an instantaneous minimum emergency stopping distance, and ascertains whether the instantaneous effective distance is smaller than or equal to the instantaneous minimum stopping distance so as to then trigger the car brake of each moved elevator car.

4. The method according to claim 3 wherein the control system detects the relative speed of the elevator cars in that a rotational frequency of a roller, which roller is fastened to the upper elevator car and on which is wound up a flexible support element having an unwound length substantially corresponding with the critical minimum distance, when on falling below of the minimum distance a weighting body impinges on the lower elevator car and in that case releases the roller for rotation.

5. The method according to claim 4 wherein a tension force exerted by the weighting body on the support element secures the roller against rotation thereof before the weighting body impinges on the lower elevator car, and the roller is released for rotation when the tension force exerted by the weighting body on the support element ceases when the weighting body impinges on the lower elevator car.

6. An elevator installation with at least one upper elevator car and at least one lower elevator car, which cars in normal operation of the elevator installation are vertically movable independently of one another in a common shaft, wherein the upper elevator car has a first driving and braking system with a first stopping brake and the lower elevator car has a second driving and braking system with a second stopping brake and wherein a collision protection system is provided, by which triggering of the stopping brakes can be initiated when an instantaneous distance between the elevator cars is less than a critical minimum distance, comprising:

an emergency stop system activated in response to triggering of the stopping brakes with a control system by which the instantaneous movement state of the elevator cars is detectable in the case of a further falling below of the minimum distance after triggering of the stopping brakes and emergency stop criteria are ascertainable and with a first car brake for the upper elevator car and a second car brake for the lower elevator car, wherein one or both car brakes can be triggered when the emergency stop criteria are fulfilled.

7. The elevator system according to Claim 6 wherein the control system for detecting the instantaneous movement state of the elevator cars after triggering of the holding brakes comprises:

means for determining the instantaneous effective distance between the elevator cars;

means for determining the relative speed of the elevator cars;

means for determining the minimum stopping distance of the elevator cars with consideration of the relative speed of the elevator cars;

means for comparing the instantaneous minimum stopping distance with the instantaneous effective distance; and means for triggering the car brake of each moved elevator car when the effective distance is less than or equal to the minimum stopping distance.

8. The elevator system according to claim 7 wherein said means for determining the relative speed and the effective distance of the elevator cars comprise a flexible support element with a first end which is fixed to a roller and can be wound up on said roller and with a second end to which a weighting body is fastened, wherein a length of the flexible support element together with the weighting body corresponds with the critical minimum distance, and wherein said roller is rotatably fastened to the upper elevator car, comprises an internal energy store by which a winding force can be exerted on said roller by which the roller can be set into rotation, is coupled with means for detecting its rotational frequency, is blocked against rotation by a tension force, which is exerted by the weighting body on the support element, when the distance between the elevator cars is greater than the critical minimum distance and rotates under the winding force when the weighting body has impinged on the lower elevator car, and with means for calculating the relative speed and the effective distance from the rotational frequency of the roller.

9. The elevator system according to claim 6 wherein said collision protection system comprises: a first safety circuit with a first electromechanical switching mechanism, by which the stopping brake of the first elevator car can be triggered, at the first elevator car and a second safety circuit with a second electromechanical switching mechanism, by which the stopping brake of the second elevator car can be triggered, at the second elevator car, wherein the first switching mechanism comprises the support element and the weighting body, is held under the weight of the weighting body in a travel setting and by which said first holding brake can be activated after impinging of the weighting body, and wherein the second switching mechanism is arranged below the weighting body, is held in a travel setting before the impinging of the latter and by which the second holding brake is activatable after impinging of the weighting body.

10. A method of preventing collision of two elevator cars, which cars move substantially independently of one another in a common shaft, of an elevator installation, wherein a collision protection system triggers a retardation of each moved elevator car by a stopping brake when an effective distance between the elevator cars falls below a critical minimum distance, comprising the steps of:

after triggering of the stopping brake an emergency stop system ascertains, by a control system, instantaneous movement states of the elevator cars;

the emergency stop system triggers, by the car brakes associated with the elevator cars, an additional retardation of one or both of the elevator cars when a movement state thereof fulfils definable emergency stop criteria;

wherein the control system for ascertaining the instantaneous movement states of the elevator cars repeatedly detects the instantaneous relative speed of the elevator cars, with consideration of the instantaneous relative speed ascertains an instantaneous effective distance between the elevator cars, ascertains as an emergency stop criteria an instantaneous minimum emergency stopping distance, and ascertains whether the instantaneous effective distance is smaller than or equal to the instantaneous minimum stopping distance so as to then trigger the car brake of each moved elevator car; and wherein the control system detects the relative speed of the elevator cars in that a rotational frequency of a roller, which roller is fastened to the upper elevator car and on which is wound up a flexible support element having an unwound length substantially corresponding with the critical minimum distance, when on falling below of the minimum distance a weighting body impinges on the lower elevator car and in that case releases the roller for rotation.

11. The method according to claim 10 wherein a tension force exerted by the weighting body on the support element secures the roller against rotation thereof before the weighting body impinges on the lower elevator car, and the roller is released for rotation when the tension force exerted by the weighting body on the support element ceases when the weighting body impinges on the lower elevator car.

* * * * *